US005971223A

United States Patent [19]

Fisscher

[11] Patent Number: 5,971,223

[45] Date of Patent: Oct. 26, 1999

[54] LIQUID DISPENSER AND CAP VALVE ASSEMBLY THEREFOR

[75] Inventor: Abraham J. Fisscher, Atlanta, Ga.

[73] Assignee: Georgia-Pacific Corporation, Atlanta, Ga.

[21] Appl. No.: 09/175,447

[22] Filed: Oct. 20, 1998

Related U.S. Application Data

[62] Division of application No. 08/768,562, Dec. 18, 1996, Pat. No. 5,855,302.

[51] Int. Cl.[6] ..... B65D 37/00

[52] U.S. Cl. ..... 222/207; 222/214; 222/494

[58] Field of Search ..... 222/207, 214, 222/494, 181.1, 181.3, 509

[56] References Cited

U.S. PATENT DOCUMENTS

| | | |
|---|---|---|
| 1,326,880 | 12/1919 | Rose . |
| 2,143,661 | 1/1939 | Schrader . |
| 2,353,153 | 7/1944 | Ferrel . |
| 2,680,477 | 6/1954 | Schira, Jr. . |
| 2,701,737 | 2/1955 | Lipman . |
| 2,808,966 | 10/1957 | Hall et al. . |
| 2,824,672 | 2/1958 | Wersching . |
| 3,828,985 | 8/1974 | Schindler . |
| 4,696,415 | 9/1987 | Meshberg . |
| 4,776,495 | 10/1988 | Vignot . |
| 4,863,070 | 9/1989 | Andris . |
| 4,875,603 | 10/1989 | Weinstein . |
| 4,978,036 | 12/1990 | Burd . |
| 5,014,881 | 5/1991 | Andris . |
| 5,152,434 | 10/1992 | Birmelin . |
| 5,165,577 | 11/1992 | Ophardt . |
| 5,184,760 | 2/1993 | Weinstein et al. . |
| 5,373,970 | 12/1994 | Ophardt . |
| 5,855,302 | 1/1999 | Fisscher ..... 222/207 |

FOREIGN PATENT DOCUMENTS

| | | |
|---|---|---|
| 0 242 253 | 10/1987 | European Pat. Off. . |
| 94 16 473 | 12/1994 | Germany . |

*Primary Examiner*—Gregory L. Huson
*Attorney, Agent, or Firm*—Banner & Witcoff, Ltd.

[57] ABSTRACT

A liquid dispenser and cap valve assembly therefor is provided to dispense a controlled dose of liquid. The liquid dispenser and cap valve assembly therefor is particularly suitable for dispensing liquid soaps and lotions. The liquid dispensing cap valve assembly comprises a dosing cap having an upper portion and a lower portion, a divider piece mounted in the dosing cap, and two oppositely acting check valves. The lower portion and the divider piece defines a dosing reservoir. A first check valve mounted on the divider piece serves to open and close a liquid passageway from a storage container to the dosing reservoir, depending on a fluid pressure in the dosing reservoir. A second check valve fixedly mounted to the lower portion serves to open and close a liquid passageway from the dosing reservoir to an outlet orifice, acting oppositely to the first check valve. The liquid dispenser comprises a liquid storage container, the cap valve assembly connected to the storage container, an actuator assembly having an actuation lever, and a mounting member. The mounting member provides first and second pivotal mounting locations for the actuation lever. When the actuation lever is mounted in the first location, the lever serves to actuate a liquid dispensing movement by pivotal motion in one direction. Conversely, when the lever is mounted in the second location, it serves to actuate the movement by pivotal motion in an opposite direction.

3 Claims, 4 Drawing Sheets

LIQUID DISPENSER AND CAP VALVE ASSEMBLY THEREFOR

This application is a division of application Ser. No. 08/768,562, filed Dec. 18, 1996 now U.S. Pat. No. 5,855,302.

BACKGROUND OF THE INVENTION

The present invention relates to liquid dispensers and cap valve assemblies for dispensing a controlled dose of liquid. In particular, the invention relates to liquid dispensers and cap valve assemblies especially suited for dispensing liquid soaps and lotions.

Known liquid dispensers typically comprise a storage container, a housing in which the storage container is mounted, a cap valve assembly attached to the storage container, and a valve actuator. There are many applications for a liquid dispenser that can dispense a controlled amount of liquid. For example, it is convenient to use such a dispenser for liquid hand soap in a rest room. Ordinarily, the hand soap dispenser is installed on a wall of the rest room, and users can receive a desired amount of hand soap by moving the attached actuator, e.g., a lever, a button, or the like. In a different environment, the dispenser may also be utilized to dispense condiments, e.g., ketchup or mustard.

The basic structure of a liquid dispensing cap valve assembly comprising a resilient dosing reservoir and a pair of oppositely acting check valves is known in the art. One known type of liquid dispensing valve assembly has a dosing cap having an open end securable on a storage container, resilient reservoir walls, and a dispensing orifice. See U.S. Pat. No. 3,828,985 (Schindler). In one embodiment, the cap may be integrally molded as a single piece. However, the valve assembly disclosed in the Schindler patent has a spring loaded disk for opening and closing a passageway for liquid to flow out of the orifice. The valve also has an upper check valve comprising a sealing element loosely fitted in an aperture of an inlet orifice, for allowing a liquid to flow from the storage container and into the dosing reservoir. Similar to the Schindler patent, the Burd U.S. Pat. No. 4,978,036 discloses a lower check valve with a spring-loaded ball. An upper check valve of the Burd patent comprises a resilient sealing flap or a floating ball.

The cap valves of the Schindler and Burd patents have numerous operative parts. The Schindler valve assembly has at least six parts. Specifically, the Schindler valve assembly in FIG. 2 comprises retaining clapper 2, spring 3, a raining disk 5, separating member 6, valve body 16, and apertured disk 20. The Burd valve assembly includes six parts: cylindrical wall 147, nozzle assembly 151, second check valve means 167, bias spring 173, planer member 150, and valve means 163. See FIG. 10 of the Burd patent. Needless to say, assembling a large number of parts is laborious and drives up the manufacturing cost. Additionally, the valve assemblies as in the Schindler and Burd patents may be unsuited for recycling because the assemblies include a spring, which is typically made of metal, thus requiring a sort of the metal piece from plastic pieces.

Another known type of valve assembly, produced by Stockhausen, Inc., of Greensboro, N.C., uses a resilient sealing disk mounted on a pedestal movable within a cylinder, in place of a spring-loaded disk and resilient reservoir walls. In this arrangement, the down stroke of the sealing disk creates vacuum within the cylinder reservoir to draw liquid into the reservoir. On the other hand, the up stroke of the sealing disk generates pressure within the reservoir. The pressure causes the circumferential edges of the sealing disk to deform away from the cylinder walls, creating a passageway and allowing the liquid to be dispensed. Although this type of valve assembly does not demand as many parts as the spring-loaded valve types, abrasion due to the sliding action of the disk edges against the cylinder walls may result in a loss of the seal rendering the valve partially or wholly in operative. Moreover, the valve might not smoothly operate, or become jammed in the cylinder due to residue from the dispensed liquid or imperfect sizing of the parts.

Known mechanisms for actuating cap valve assemblies include an actuator, such as a pivotable lever arm, attached to a liquid dispensing cap valve assembly. In some arrangements, the liquid is dispensed when the actuator is pulled towards the user. In other arrangements, liquid is dispensed by pushing a lever. Because personal and market preferences between the two types of actuators varies, a liquid dispenser having versatility to readily switch between both types of dispensing action, without any change of parts would be desirable.

SUMMARY OF THE INVENTION

In view of foregoing, it is general object of the present invention to provide an improved liquid dispenser and cap valve assembly therefor.

More specifically, it is an object of the invention to provide a cap valve assembly having a reduced member of parts, thus simplifying the assembly process.

Another object of the invention is to provide a cap valve assembly whose parts are made exclusively of molded plastic, thereby facilitating recycling of the parts by eliminating the need for a sorting process.

Still another object of the invention is to provide a cap valve assembly as aforesaid that is not prone to malfunction, e.g., leakage and loss of seal due to abrasion of moving parts.

Yet another object of the invention is to provide a liquid dispenser which allows versatility to accommodate personal and market preferences as to the dispensing action of an actuator.

These and other objectives are achieved in accordance with the present invention by a liquid dispenser cap assembly. The assembly comprises a dosing cap which has an upper portion connectible to a liquid storage container and a lower portion having an outlet orifice. A divider piece is mounted within the cap between the upper and lower portions. The divider and the lower portion define a dosing reservoir that is expansible and contractible by application of external forces thereto. A first check valve is mounted on the divider piece and serves to open and pass liquid from the storage container into the reservoir in response to a decrease in fluid pressure caused by an external force induced expansion of the reservoir. The first check valve also serves to remain closed in order to prevent liquid from returning to the storage container from the reservoir during periods of increased fluid pressure brought about by an external force induced contraction of the reservoir. A second check valve comprises a valve seal element mounted on and extending outwardly from a pedestal fixedly mounted to the lower portion. The seal element has a flexible outer edge portion provided in sealing contact with a surrounding wall of the lower portion. The flexible edge portion is resiliently deformable away from the wall under fluid pressure developed in the reservoir by the contraction, to create a passageway for liquid to flow out of the reservoir and the outlet orifice. The edge portion is configured to remain in contact with the wall, forming a seal therewith, under a decrease in fluid pressure caused by the expansion.

In another aspect, the invention is embodied in a liquid dispenser. The liquid dispenser comprises a liquid storage container, a cap valve assembly connected with the storage container and having a movable operation member, and an actuator assembly for actuating movement of the operation member to dispense liquid from the storage container. The actuator assembly comprises an actuation lever connectible with the operation member, and a mounting member providing first and second pivotable mounting locations for the actuation lever. The actuation lever, when mounted in the first mounting location, serves to actuate a liquid dispensing movement of the operation member when pivoted in a first direction, and when mounted in the second mounting location, serves to actuate a liquid dispensing movement if the operation member when pivoted in a second direction opposite the first direction.

These and other objects, features and advantages of the present invention will become apparent and fully understood from the following detailed description of the preferred embodiments, taken in connection with the appended drawings.

DETAILED DESCRIPTION OF THE PREFERRED EMBODIMENTS

Figure 1:
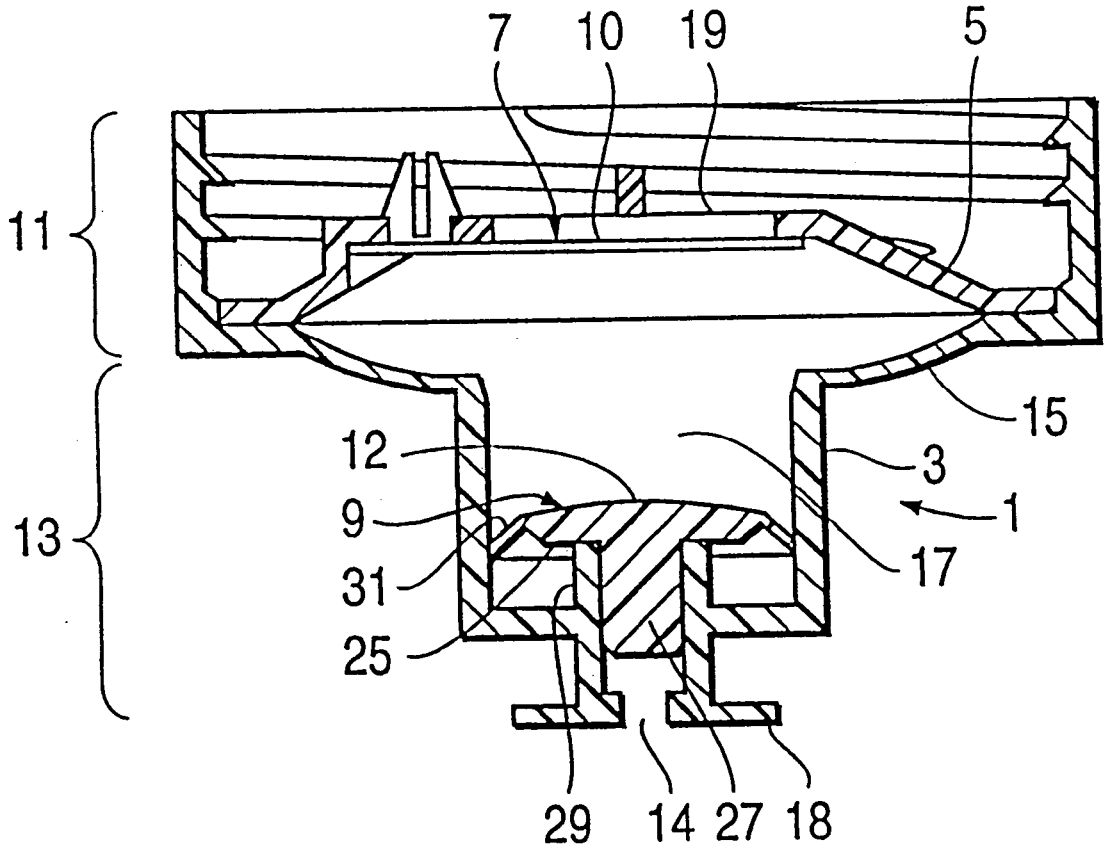
FIG. 1 is an axial cross-sectional view of the cap valve assembly according to the present invention.

Referring first to FIG. 1, illustrated is a cap valve assembly 1 in accordance with the present invention. Cap valve assembly 1 comprises a dosing cap 3, a divider piece 5, a first check valve 7, and a second check valve 9. In a preferred embodiment, cap valve assembly 1 consists of only four parts: dosing cap 3, divider piece 5, and movable valve elements 10, 12 of valves 7, 9 respectively. Having a reduced number of parts simplifies the assembly process. All the parts can be readily manufactured from molded plastic by conventional techniques. Making cap valve assembly 1 exclusively of molded plastic facilitates recycling of the parts because it eliminates the need for a parts sorting process.

Dosing cap 3 has an upper portion 11 connectible to a liquid storage container and a lower portion 13 having an outlet orifice 14. In the illustrated embodiment, dosing cap 3 comprises a resilient wall 15 in lower portion 13. Resilient wall 15 is deformable by an application of external forces. Preferably, upper portion 11 and lower portion 13 are integrally molded as a single piece. Preferably, upper portion 11 of dosing cap 3 is threaded for easy attachment to a liquid storage container. Also, lower portion 13 has a flange structure 18 for connection of a dispensing actuator.

Figure 2:
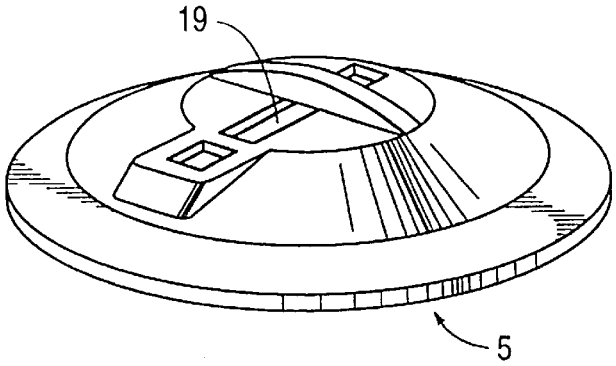
FIG. 2 is a perspective view of a divider piece, and a first check valve associated therewith, of the cap valve assembly.

Divider piece 5 is mounted within dosing cap 3 between upper portion 11 and lower portion 13. Divider piece 5 is friction-fit within dosing cap 3, thereby eliminating the need for adhesives. Importantly, divider piece 5 and lower portion 13 define a dosing reservoir 17 within dosing cap 3. As depicted in FIG. 2, divider piece 5 has an aperture 19 for liquid to pass from the liquid storage container to dosing reservoir 17.

Referring back to FIG. 1, dosing reservoir 17 acts as a temporary retainer for the liquid to be dispensed, capable of retaining a predetermined amount of the liquid. Resilient wall 15 allows dosing reservoir 17 to be expanded and contracted by application of external forces. By changing the internal volume of dosing reservoir 17, fluid pressure inside dosing reservoir changes inversely, thereby controlling first and second check valves 7, 9.

First check valve 7 is provided on divider piece 5. In a preferred embodiment, first check valve 7 is a reed valve, and associated valve element 10 comprises a resilent flap and cantilever mounting structure which can be snap-fitted onto divider piece 5. First check valve 7 serves to open and close valve aperture 19 depending on the fluid pressure inside dosing reservoir 17. When a downward pulling force on flange 18 induces expansion of dosing reservoir 17, a decrease in a fluid pressure in dosing reservoir 17 causes first check valve 7 to open, and liquid flows through aperture 19 into dosing reservoir 17 from the storage container, under force of gravity and/or vacuum, until dosing reservoir 17 is filled. Conversely, when an upward pushing force on flange 18 induces contraction of reservoir 17, an increase in the fluid pressure in dosing reservoir 17 causes the resilent flap of element 10 on flange 18 to completely seal aperture 19 and prevent the liquid from flowing back into the storage container.

Figure 3:
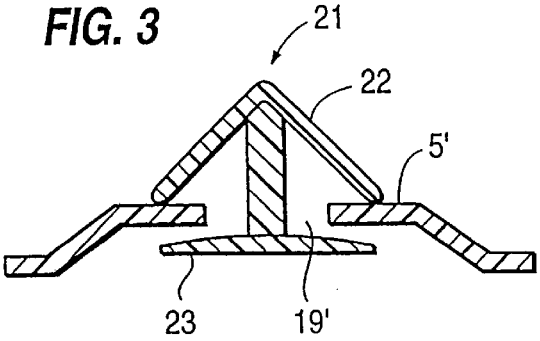
FIG. 3 is a sectional view illustrating an alternative first check valve structure.

FIG. 3 illustrates an alternative first check valve structure. A movable valve element 21 is loosely fitted into a circular aperture 19', retained on a divider piece 5' by a conical cap structure 22 and a sealing element 23. This arrangement allows liquid to normally flow through aperture 19' when check valve 21 is open, as in FIG. 3. However, with an increase in the fluid pressure, valve element 21 is pushed upward, and a semi-spherical upper surface of sealing element 23 completely closes aperture 19', thereby preventing the fluid from flowing back into the storage container.

Figure 5:
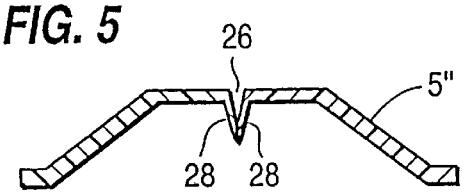
FIG. 5 is a sectional view taken on line A—A in FIG. 4.
Figure 4:
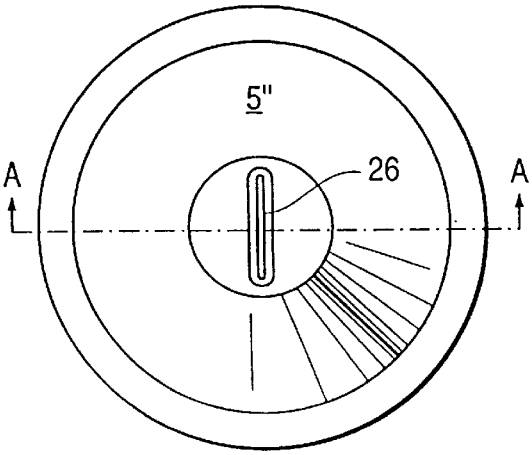
FIG. 4 is a top plan view illustrating a second alternative first check valve structure.

FIGS. 4–5 illustrate a second alternative structure of the first check valve. A modified divider piece 5" has passageway 26 which is opened and closed by a pair of resilent flaps 28. Lower edges of resilent flaps 28 are normally held together in a V-configuration by a relatively small bias force of the flap material. A relative decrease in fluid pressure within dosing reservoir 17 caused by a downward pull on flange 18 causes flaps 28 to temporarily separate in order to open passageway 26 and thereby let liquid flow into dosing reservoir 17 from the storage container. Divider piece 5" can be molded in the shape shown and then slit in a secondary operation to form resilent flaps 28.

Figure 6:
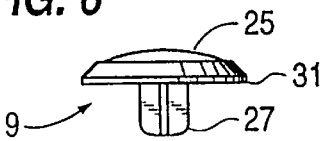
FIG. 6 is a side elevation view of a valve element of a second check valve of the cap valve assembly.
Figure 7:
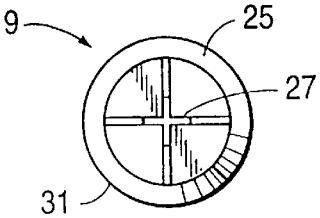
FIG. 7 is a bottom plan view of the second check valve element shown in FIG. 6.

Referring to FIGS. 1, 6 and 7, a second check valve 9 comprises a mushroom-shaped valve seal element 12 fixed within lower portion 13. Element 12 comprises a disk 25 and a pedestal 27. Pedestal 27 is friction-fit within a cylinder 29 of lower portion 13. Pedestal 27 has a flanged structure (see FIGS. 6–7) allowing liquid to pass through cylinder 29 to orifice 14. The thickness of disk 25 reduces outwardly to a flexible outer edge 31.

The above arrangement allows second check valve 9 to act oppositely to first check valve 7 with respect to changes in the fluid pressure in dosing reservoir 17. When a downward pulling force on flange 18 induces a decrease in the fluid pressure in dosing reservoir 17, outer edge 31 remains in sealing contact with an internal cylindrical wall of lower portion 13. Therefore, while the first check valve is open and liquid passes from the storage container to dosing reservoir 17, second check valve 9 remains closed and prevents the liquid in dosing reservoir 17 from passing through to outlet orifice 14.

On the other hand, when a pushing force on flange 18 induces an increase in the fluid pressure in reservoir 17, the increased fluid pressure causes outer edge 31 to resiliently deform downwardly and away from the cylindrical internal wall of lower portion 13, thereby creating a passageway for the liquid to pass through second check valve 9 and flow out of dosing reservoir 17 through outlet orifice 14. Because valve seal element 12 does not move with respect to cylinder 29, and incurs no frictional motion, it is not prone to malfunction due to abrasion of moving parts.

Figure 8:
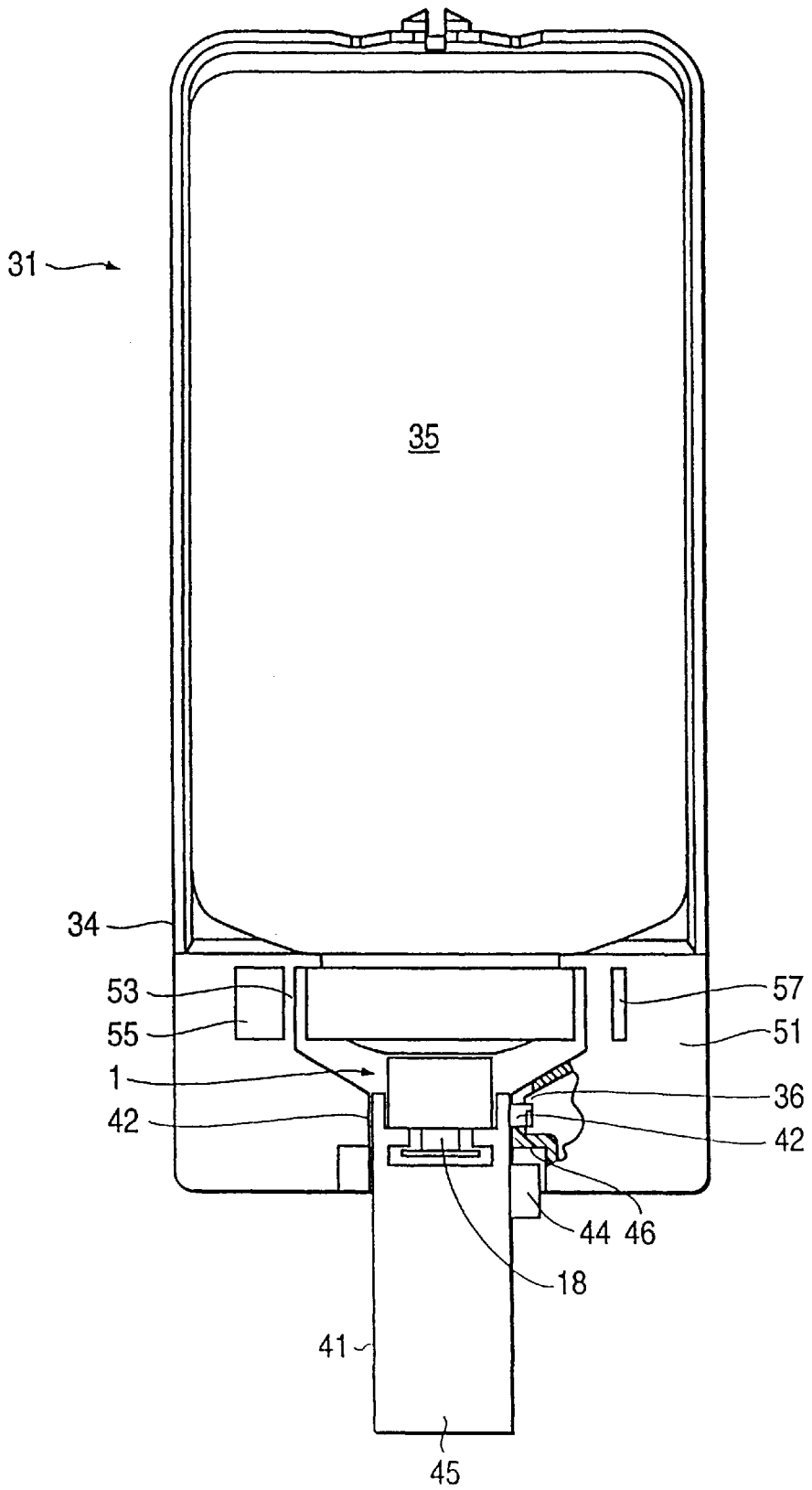
FIG. 8 is a front elevation view, partially broken-away, of a liquid dispenser according to the present invention, with a front housing cover and brace thereof removed.
Figure 9:
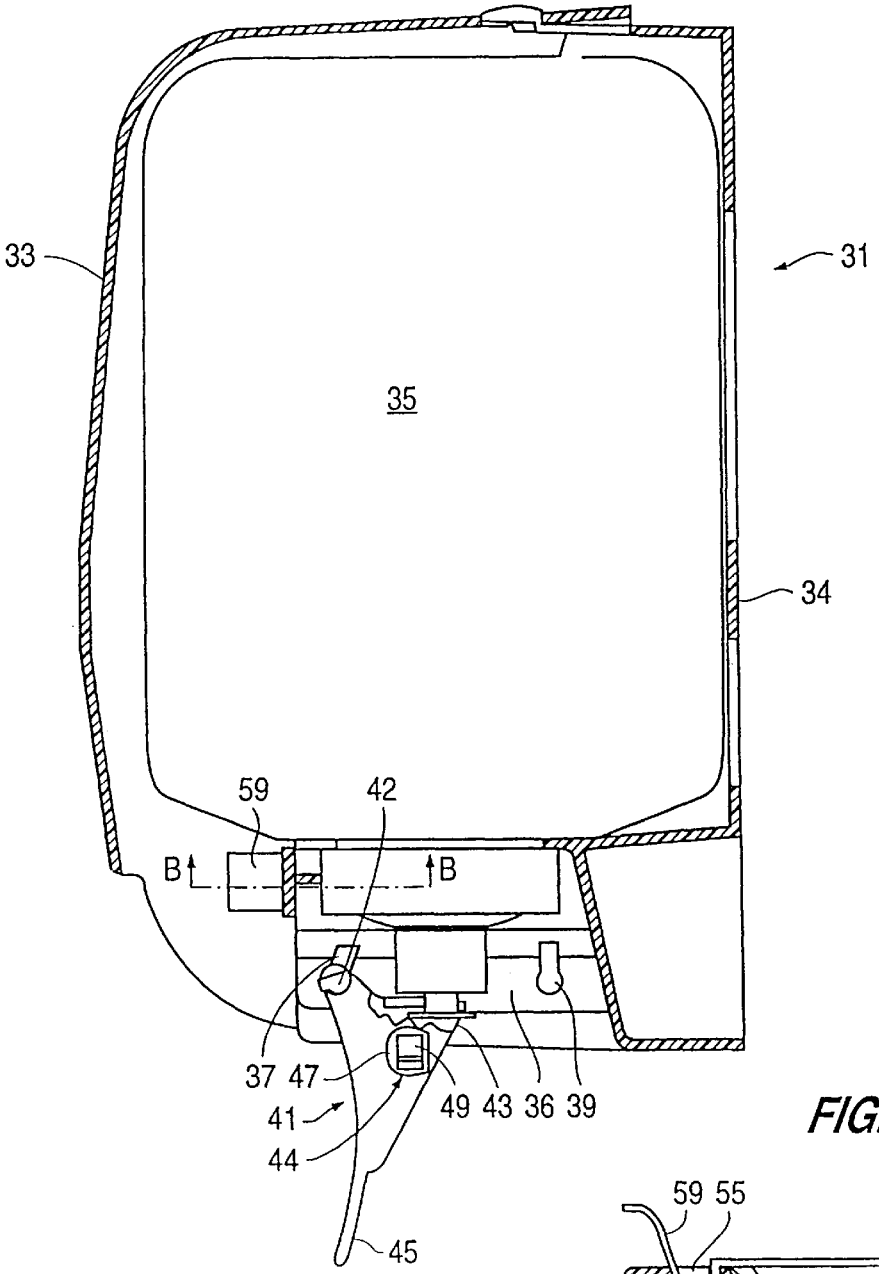
FIG. 9 is a sectional view of the liquid dispenser shown in FIG. 8, with the cap valve assembly and an actuator lever shown in partially broken-away side elevation.
Figure 10:
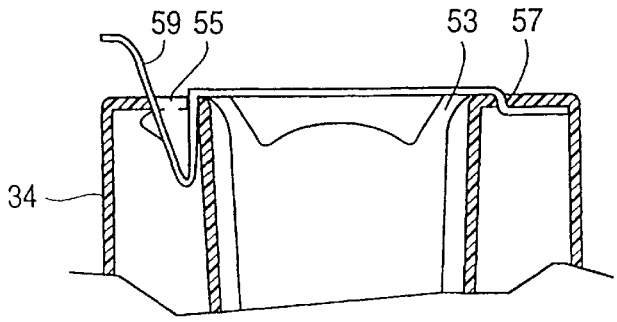
FIG. 10 is a sectional view taken on line B—B in FIG. 9.

Referring to FIGS. 8–10, illustrated is a liquid dispenser 31 in accordance with the present invention. Liquid dispenser 31 comprises a housing including a front cover 33 (see FIG. 9) removably secured to a wall-mountable base 34. A liquid storage container 35 is contained within an upper part of the housing. The housing and liquid storage container 35 can be made of plastic by conventional techniques. Container 35 is filled with liquid soap or other liquid product to be dispensed. Preferably, liquid storage container 35 has a threaded opening for threadably receiving cap valve assembly 1. Container 35 may be a closed collapsible type which progressively collapses as the liquid contents is drawn out.

Cap valve assembly 1 is attached to liquid storage container 35, and resides within a smaller lower part of the housing. In addition, the lower part of base 34 serves as part of an actuator assembly, for actuating dispensing from cap valve assembly 1. In particular, opposed in-set side walls 36 (only one visible) of the lower part of base 34 are provided with two pairs 37, 39 of aligned pivot holes (only one hole of each pair visible) for pivotally mounting an actuation lever 41, in one of two alternative positions. As seen in FIG. 9, actuation lever 41 has a generally triangular shape. A pair of aligned pivot pins 42 are provided at one corner of lever 41, having protruding ends which are selectively received in the aligned holes of one of pivot hole pairs 37, 39 (as shown, front pivot hole pair 37). A second corner of lever 41 is provided with a fork-like structure 43 for engaging with flange 18 of cap valve assembly 1. The remaining corner of lever 41 provides a hand-graspable tab 45 for pivoting lever 41, about pivot pins 42, to thereby dispense liquid from cap valve assembly 1.

Having two mounting locations provides versatility in order to accommodate personal and market preferences as to the dispensing action of actuation lever 41. Actuation lever 41 can be pivotally mounted in either location simply and securely, without the need for any additional parts or tools. Specifically, each of the pivot holes of pivot hole pairs 37, 39 is shaped as a key-way. The protruding ends of pivot pins 42 are keyed to fit into the pivot holes when appropriately oriented, and to become rotatably secured therein once rotated to a use position with structure 43 engaged with flange 18 of cap valve assembly 1.

Pivot hole pair 37 is provided forwardly of flange 18 of cap valve assembly 1. Pivot hole pair 39 is provided rearwardly of flange 18. When actuation lever 41 is mounted in hole pair 37 (as shown), it serves to actuate a liquid dispensing movement of flange 18 when pushed rearwardly, away from the user. On the other hand, when reverse-mounted in pivot hole pair 39, actuation lever 41 serves to actuate a liquid dispensing movement when pulled toward the user. The amount dispensed per stroke of lever 41 can be controlled by a calibration member 44 mounted to the side of actuation lever 41, which abuts with an opposed recessed surface 46 of sidewall 36. As best seen in FIG. 9, adjustability of the stroke is provided by calibration member 44 which comprises a collar 47 mountable on a square post 49 and having sides of different thickness. By rotating collar 47 at intervals of 90°, before it is mounted on post 49, the clearance between collar 47 and opposed recessed surface 46, and hence the stroke of lever 41, can be varied.

As best seen in FIG. 8, a front wall 51 of the lower part of base 34 is provided with a main cut-out 53 generally corresponding in shape to cap valve assembly 1. This allows storage container 35, with cap valve assembly 1 secured thereto, to be mounted on base 34, whereafter front cover 33 can be secured on base 34 to enclose container 35 and cap valve assembly 1. In addition, secondary cutouts 55, 57 are provided adjacent main cut-out 47 for mounting a clip-type brace 59, in the manner best seen in FIG. 10, serving as a further means for holding cap valve assembly 1 in place.

The present invention has been described in terms of preferred embodiments thereof. Other embodiments, features, and variations within the scope and spirit of the appended claims will occur to persons skilled in the art from a review of this disclosure.

I claim:

1. A liquid dispenser comprising a liquid storage container, a cap valve assembly connected with said storage container, said cap valve assembly having a movable operation member, and an actuator assembly for actuating movement of the operation member to dispense liquid from said storage container, said actuator assembly comprising an actuation lever connectible with said operation member, and a mounting member providing first and second pivotable mounting locations for said actuation lever, said actuation lever, when mounted in said first mounting location, serving to actuate a liquid dispensing movement of the operation member when pivoted in a first direction, and when mounted in said second mounting location, serving to actuate a liquid dispensing movement of the operation member when pivoted in a second direction opposite said first direction.

2. A liquid dispenser according to claim 1, wherein said mounting member comprises a pair of walls extending along opposite sides of said operation member and providing said first and second pivotable mounting locations forwardly and rearwardly of said operation member, respectively, whereby when said actuation lever is mounted in said first mounting location, said liquid dispensing movement is actuated by pushing said actuation lever rearwardly, and when said actuation lever is mounted in said second mounting location, said liquid dispensing action is actuated by pulling said actuation lever forwardly.

3. A liquid dispenser according to claim 2, wherein said first and second mounting locations are defined by forward and rearward pairs of pivot holes provided in said walls, for receiving a pivot pin of said actuation lever.

* * * * *